US009289761B2

(12) United States Patent
Kelley et al.

(10) Patent No.: US 9,289,761 B2
(45) Date of Patent: Mar. 22, 2016

(54) CARD WASTE STORAGE MECHANISM

(71) Applicants: Mark Kelley, St. Paul, MN (US); Ron Bardell, St. Louis Park, MN (US); Tighe Belden, Minneapolis, MN (US)

(72) Inventors: Mark Kelley, St. Paul, MN (US); Ron Bardell, St. Louis Park, MN (US); Tighe Belden, Minneapolis, MN (US)

(73) Assignee: Honeywell International Inc., Morris Plains, NJ (US)

( * ) Notice: Subject to any disclaimer, the term of this patent is extended or adjusted under 35 U.S.C. 154(b) by 205 days.

(21) Appl. No.: 13/678,925

(22) Filed: Nov. 16, 2012

(65) Prior Publication Data

US 2014/0137946 A1 May 22, 2014

(51) Int. Cl.
*B01L 1/00* (2006.01)
*B01L 3/00* (2006.01)

(52) U.S. Cl.
CPC ..... *B01L 1/50* (2013.01); *B01L 3/502723* (2013.01); *B01L 2200/0684* (2013.01); *B01L 2200/082* (2013.01); *B01L 2300/0816* (2013.01); *B01L 2300/0864* (2013.01); *B01L 2300/0887* (2013.01); *B01L 2400/0406* (2013.01); *B01L 2400/086* (2013.01); *Y10T 137/0318* (2015.04); *Y10T 156/1002* (2015.01)

(58) Field of Classification Search
CPC ..... B01L 2300/0816; B01L 3/5027; B01L 2300/0887; B01L 1/50
See application file for complete search history.

(56) References Cited

U.S. PATENT DOCUMENTS

| | | | | |
|---|---|---|---|---|
| 5,374,395 | A | 12/1994 | Robinson et al. | |
| 5,498,392 | A | 3/1996 | Wilding et al. | |
| 8,048,375 | B2 * | 11/2011 | Breidenthal et al. | 422/68.1 |
| 8,222,023 | B2 * | 7/2012 | Battrell et al. | 435/287.2 |
| 2003/0152994 | A1 | 8/2003 | Woudenberg et al. | |
| 2003/0214650 | A1 | 11/2003 | Dietz et al. | |

FOREIGN PATENT DOCUMENTS

| | | | |
|---|---|---|---|
| EP | 353590 | B1 | 4/1996 |
| EP | 353591 | B1 | 4/1996 |
| EP | 649534 | A4 | 5/1996 |
| EP | 1756544 | A1 | 2/2007 |
| EP | 1393068 | B1 | 12/2010 |
| NO | WO-2009/014390 | A2 | 1/2009 |
| WO | WO-2007/009125 | A2 | 1/2007 |
| WO | WO-2008/002462 | A2 | 1/2008 |
| WO | WO-2008/101196 | A1 | 8/2008 |

OTHER PUBLICATIONS

"European Application Serial No. 13188202.9, Extended European Search Report mailed Apr. 23, 2014", 3 pgs.
"European Application Serial No. 13188202.9, Office Action mailed Sep. 2, 2014", 10 pgs.
"European Application Serial No. 13188202.9, Office Action mailed Jun. 3, 2015", 5 pgs.
"European Application Serial No. 13188202.9, Response filed Mar. 4, 2015 to Office Action mailed Sep. 2, 2014", 11 pgs.

* cited by examiner

*Primary Examiner* — Sally Merkling
(74) *Attorney, Agent, or Firm* — Schwegman Lundberg & Woessner, P.A.

(57) ABSTRACT

A multiple layer test card includes a waste channel to receive biological waste from an area of the test card utilized for testing biological samples. Multiple compartments in a waste layer of the card are separated from each other by a rib in the waste layer. A first compartment is positioned to receive biological waste from the waste channel. A pass is coupled between each adjacent set of compartments to pass biological waste and air between compartments. A vent in a last compartment provides an air exit from the card.

13 Claims, 5 Drawing Sheets

CARD WASTE STORAGE MECHANISM

BACKGROUND

Detection of biological samples results in biological waste being generated. There are significant safety issues involved in properly handling and disposing of biological waste. Further, when using disposable cards to distribute and test the waste, the cards should control the waste well enough that instruments that come in contact with the card are contaminated.

SUMMARY

A multiple layer test card includes a waste channel to receive biological waste from an area of the test card utilized for testing biological samples. Multiple compartments in a waste layer of the card are separated from each other by ribs in the waste layer. The compartments may be capped by adjacent layers. A first compartment is positioned to receive biological waste from the waste channel. A pass is coupled between each adjacent set of compartments to pass biological waste and air between compartments. A vent in a last compartment provides an air exit from the card.

A method includes receiving waste liquid at a cover layer, the waste liquid being received from a layer on a multiple layer test card, using a waste pass in the cover layer to provide the received waste liquid to a waste receiving chamber in a waste storage layer, using multiple passes in the cover layer to pass liquid and air through multiple rib separated waste storage compartments in the waste storage layer, and exhausting air from the waste storage compartments to ambient outside the card.

A further method includes forming multiple rib separated adjacent compartments in a waste storage layer of a multiple layer biological liquid test card, forming a cap layer having multiple passes, the passes coupled to alternate top and bottom portions of adjacent rib separated adjacent compartments, and wherein the cap layer is further formed with a vent to exhaust gas from the card via a last compartment.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and fluidic path changes may be made without departing from the scope of the present invention. The following description of example embodiments is, therefore, not to be taken in a limited sense, and the scope of the present invention is defined by the appended claims.

Figure 1:
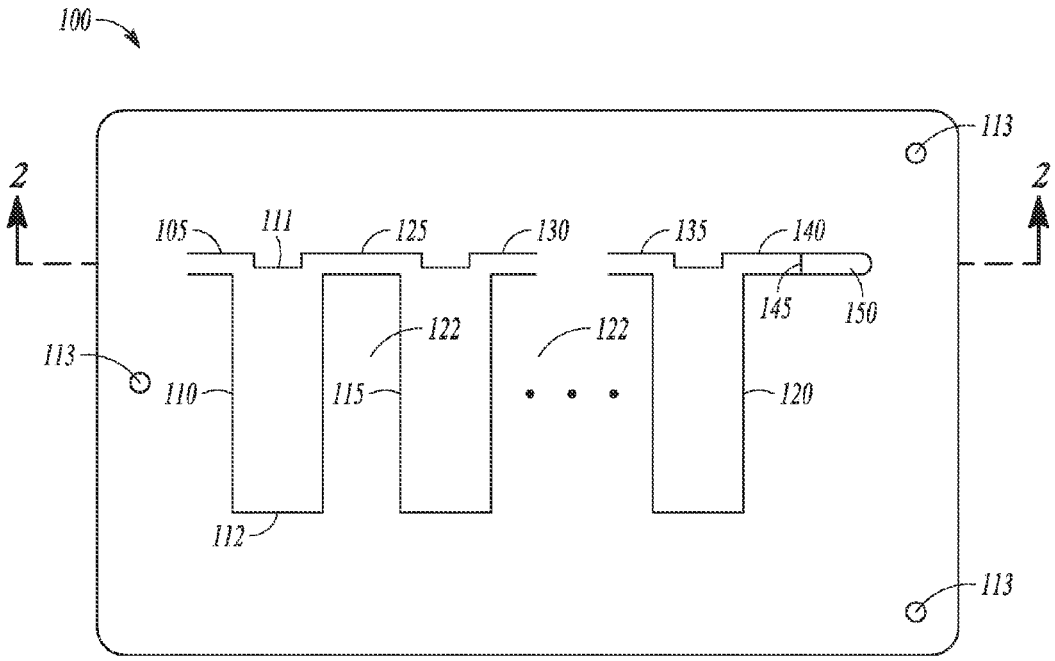
FIG. 1 is a block diagram planar view of a testing card having on board waste storage according to an example embodiment.
Figure 2:
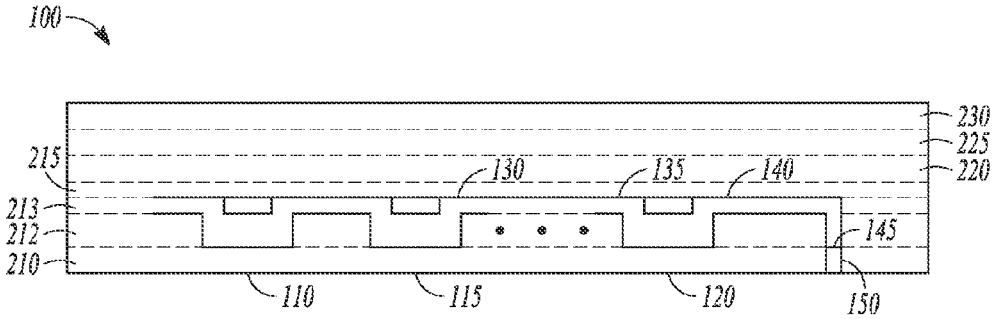
FIG. 2 is a block diagram cross section of the testing card of FIG. 1 taken along line 2-2 according to an example embodiment.

FIG. 1 is a block diagram planar view of a multiple layer test card 100 having on board waste storage according to an example embodiment. FIG. 2 is a block diagram cross section of the test card 100 of FIG. 1 taken along line 2-2 according to an example embodiment. The test card 100 in some embodiments, contains many layers of a transparent material such as PET or other acrylic or suitable material that can be patterned with various liquid fluid transport features. The card 100 in some embodiments may be used to perform one or more blood tests utilizing a small volume of blood. The blood or other liquid to be tested, may be transported via one or more layers of the test card, and prepared for analysis by a test instrument into which the card is inserted. Various sensors, such as a combination of light emitting diodes, lasers, and photoreceptors may be used to test the liquid.

After the liquid has been tested, a waste channel 105 receives the waste liquid and transports it to a first waste chamber or compartment 110. In one embodiment, the card is designed to be inserted into the test instrument such that liquid from waste channel 105 enters into a top 111 of the chamber 110 and drains to a bottom of the chamber 112. One or more registration features 113 may be used to ensure the card is properly oriented within the test instrument such that gravity assists the liquid in moving the bottom 112 of chamber 110. Multiple other chambers 115 . . . 120 may be adjacent to each other and separated by ribs 122. The ribs 122 ensure the structural integrity of the card 100 and together with the multiple waste chambers reduce sloshing of the liquid.

As the chamber 110 fills, air in the chamber is removed via a channel of pass 125 into chamber 115. Similarly, air moves through a pass 130 through a selected number of chambers as represented by dots signifying a repeating structure. In one embodiment, the passes are formed in a layer adjacent to the layer with the chambers, and serve to couple adjacent pairs of chambers and pass gas and liquid to succeeding chambers. Chamber 120 is the last chamber and is coupled to an adjacent chamber by pass 135. Chamber 120 is also coupled to an exhaust channel or pass 140 to exhaust air from the chambers. In one embodiment, a gas permeable, liquid impermeable membrane 145 is coupled in the pass 140 to ensure only gas is passed to ambient via a vent 150, providing an air exit from the card without allowing liquid to exit the card and potentially contaminate the test instrument.

As seen in FIG. 2, there are multiple layers in one embodiment of the card 100. A layer 210 serves as a cap and also contains the vent passage 150. Layer 212 contains the chambers 110 115, and 120. A layer 213 contains the passes that communicate liquid and air between the chambers and also serves as a cap for one or more other layers 215, 220, 225, and 230 that are transporting and processing the liquid that becomes waste. The number of layers in the card 100 may vary in different embodiments. The vent passage 150 in one embodiment passes air to ambient via layer 230. In further embodiments, vent passage 150 may take an alternate route to pass air to ambient.

Figure 3:
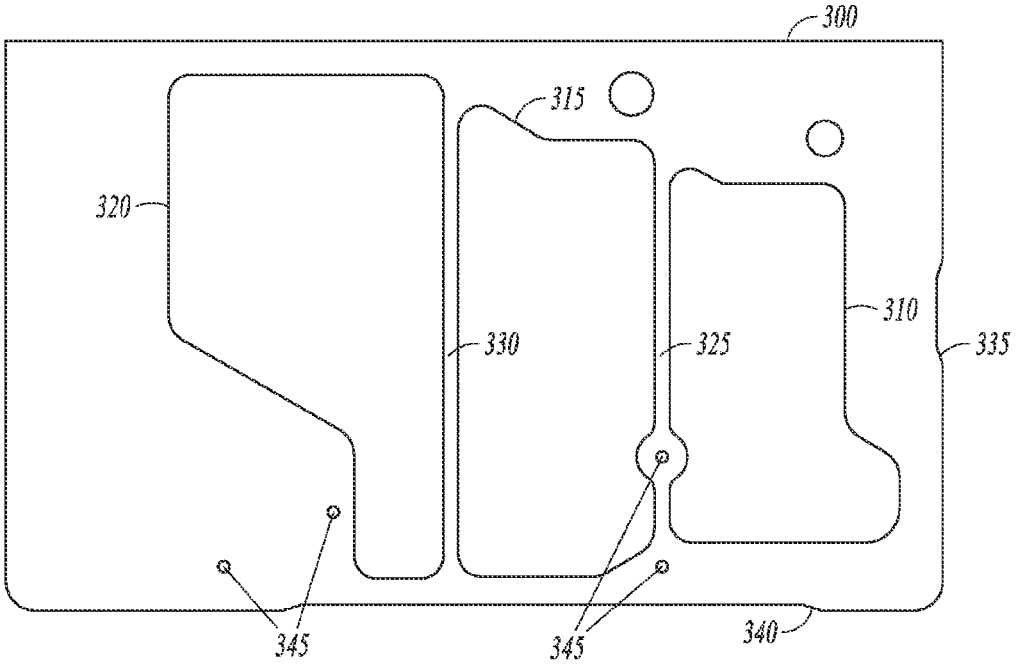
FIG. 3 is a block diagram planar view of a chamber layer of an alternative example embodiment.

FIG. 3 is a block diagram planar view of a chamber containing layer 300 of an alternative example embodiment. Layer 300 includes three chambers, 310, 325, and 320 in one embodiment. The chambers are separated from each other by ribs 325 and 330 to provide structural support. In various embodiments, features such as a chamber or pass in the respective layers are formed by removing layer material. The ribs provide a dual function of maintaining structural integrity of the layer as it is handled when being added to other layers and as it is handled during use in testing. Registration or datum features are provided as small cut ins in the layer as indicated at 335, 340. The registration or datum features may be used to help position the finally assembled card properly within the test instrument. They are cut in one embodiment to help protect the surface of the layers, and may be done as a secondary operation in manufacturing after assembly to ensure the entire surface is uniformed and controlled. Various apertures 345 are shown with channels leading to therein, and may be used for fluidic transfer between layers. Similar apertures or holes without channels leading to them may be formed to facilitate alignment of the various layers as they are being assembled to form the card.

Figure 4:
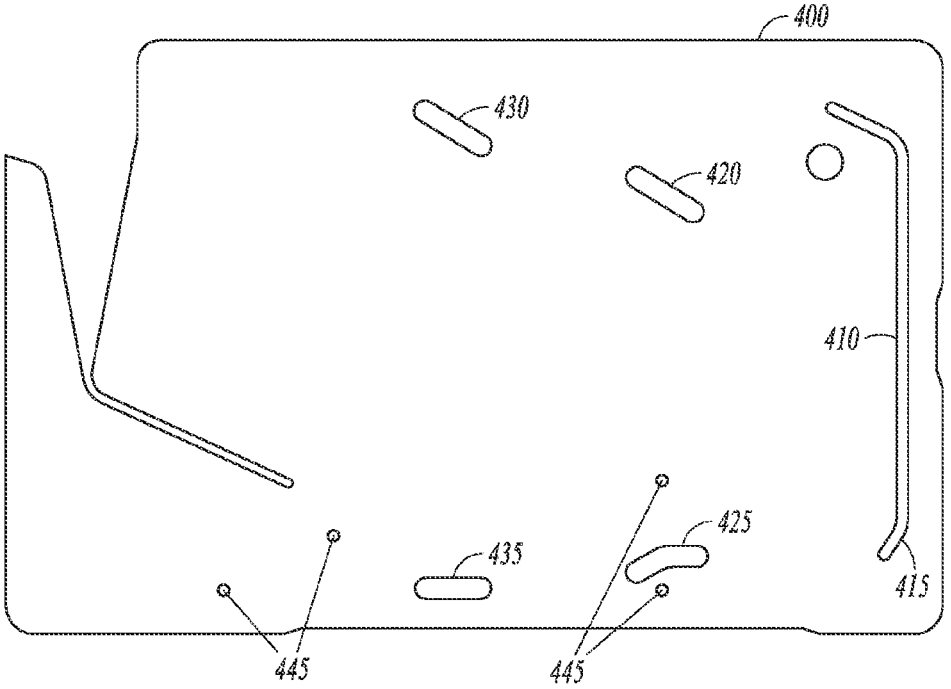
FIG. 4 is a block diagram planar view of a pass layer of an alternative example embodiment of FIG. 3.

FIG. 4 is a block diagram planar view of a pass layer 400 to be coupled to chamber layer 300 and provide passes for fluid travel between the layers. Layer 400 includes a waste pass 410 aligned to provide waste liquid at 415 to chamber 310 at the bottom of the chamber. In other embodiments, the waste pass 410 may provide the waste liquid at different entry points to the chamber 310, and gravity will operate to fill the chamber from the bottom. Fluid in chamber 310, including gas and waste liquid, will progress to the second, adjacent chamber 315 via one or more passes in layer 400. A top pass 420 and a bottom pass 425 are both provided in one embodiment, although in further embodiments, a single pass at various optional locations will suffice. The top pass 420 generally passes gas between the adjacent chambers, and the bottom pass 425 generally passes liquid between the adjacent chambers. Further top and bottom passes 430 and 435 are provided between the second chamber 315 and the third or last chamber 320 when the card is properly aligned using alignment features, which align with features on the waste layer 300. In this embodiment, the chambers are allowed to fill at the same time via the bottom passes, with the top passes generally providing a path for air as each chamber is filled with liquid. The size of the passes may be modified to control a rate of flow between chambers during filling, and after when the card is removed from the instrument.

Figure 5:
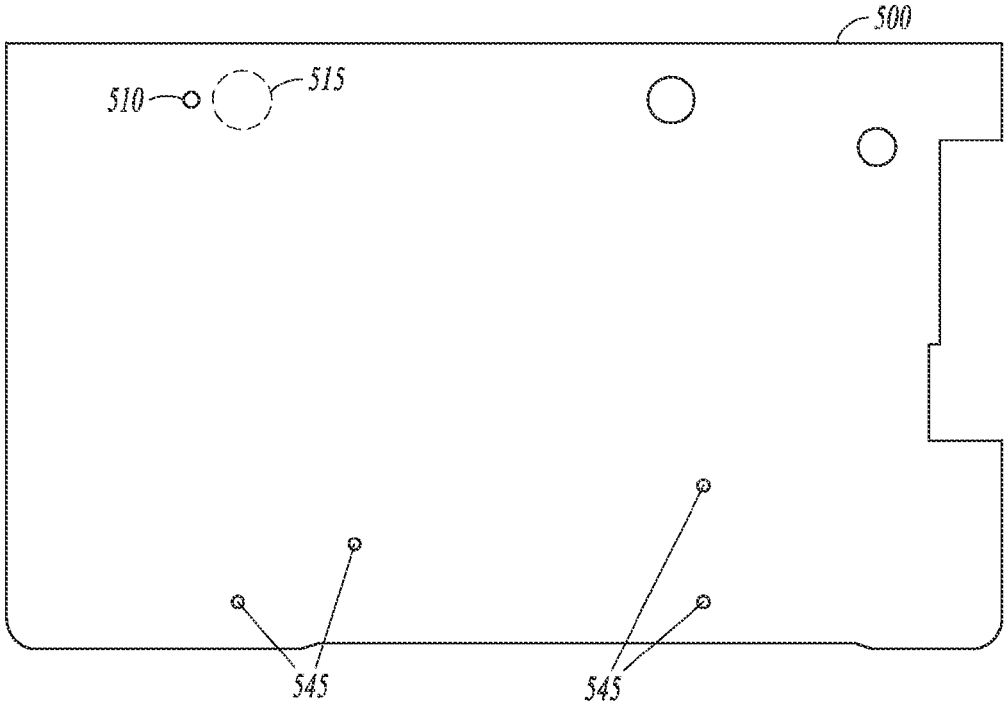
FIG. 5 is a block diagram planar view of a cap layer of an alternative example embodiment of FIG. 3.

FIG. 5 is a block diagram planar view of a cap layer 500 to be aligned to seal the chambers, and also provide a waste vent 510 to allow gas to escape from the last chamber 330. An air permeable, liquid impermeable membrane may be positioned on layer 500 or another layer as indicated by broken line 515. The membrane may be positioned such that it is held in place between adjacent layers and serves as a liquid stop for waste vent 510 while allowing air to pass to ambient. Alternatively, the waste vent geometry may be modified to ensure that surface tension contains on card liquid after the card is removed from the instrument and the liquid does not leak out without the use of a membrane. The membrane may also be used to help contain the liquid. Layer 500 may be the final layer, capping the chambers, and providing a path via vent 510 for air to ambient.

Figure 6:
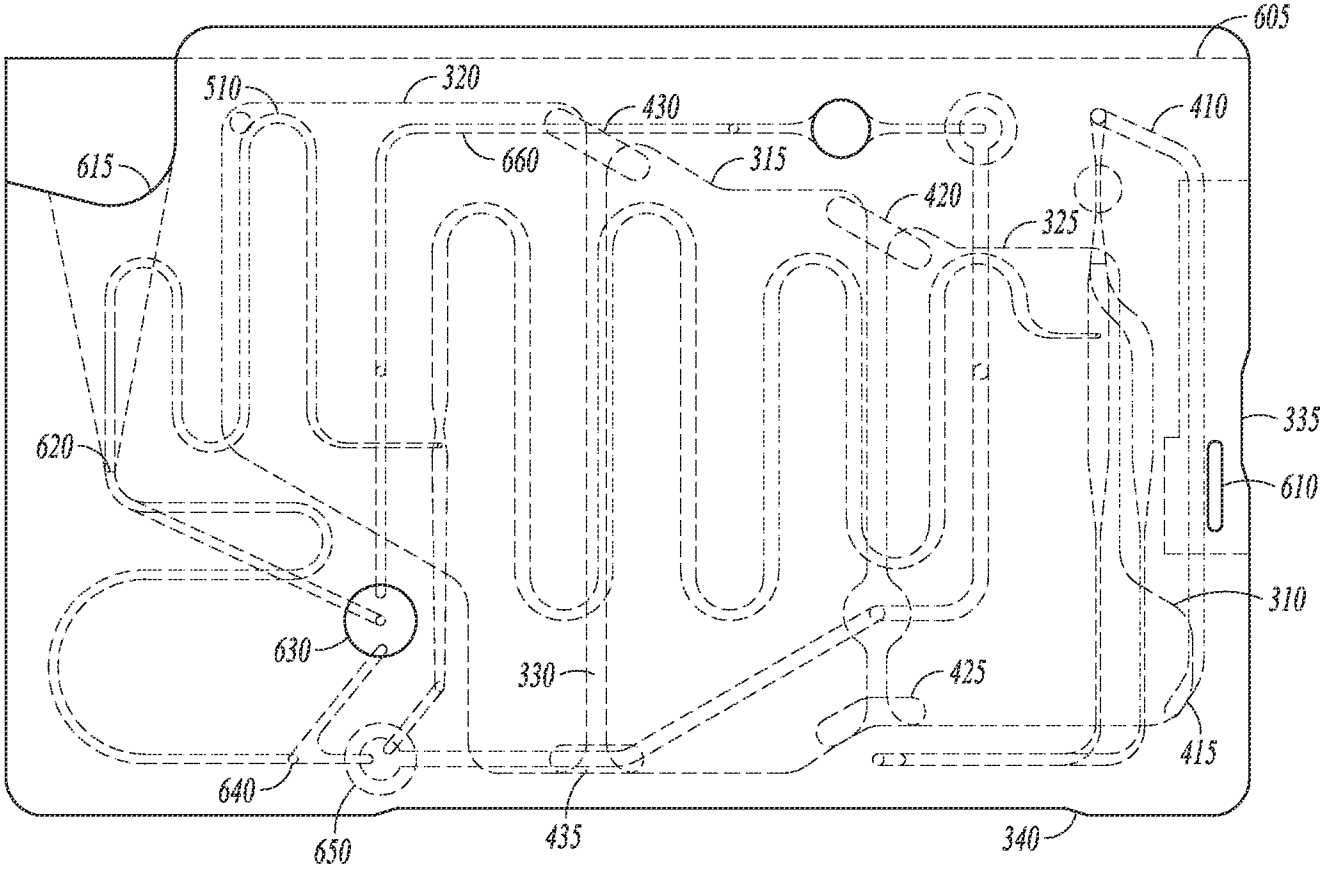
FIG. 6 is a block diagram planar view of a test card incorporating the chamber, pass, and cap layers of FIGS. 3-5 and additional layers to process liquid according to an example embodiment.

FIG. 6 is a block diagram planar view of a test card 600 incorporating the chamber layer 300, pass layer 400, and cap layer 500, and additional layers to process liquid according to an example embodiment. In one embodiment, multiple testing layers for transporting and processing a fluid, such as a biological fluid are formed of transparent material as described above. The pass layer 400 is positioned adjacent these testing layers to provide a cap to the layers and in addition to receive waste fluid from the testing layers. The pass layer 400 is followed by the chamber layer 300, and then the cap layer 500.

The pass layer 400 and chamber layer 300, as well as features of the test layers are shown in broken line form in FIG. 6. A keying feature 605 may be formed on a side of the card and is used to ensure proper orientation into the testing instrument. A card capture feature, shown as a slot 610 may be used to capture the card. The testing instrument may use the slot to grab the card and pull the card into the instrument and position the card properly within the instrument.

The testing layers of the card are not individually identified in FIG. 6, but several features that are visible from such layers include a blood insertion point 615 from which blood may be obtained directly from a finger prick or otherwise injected into from a tube. A blood capillary 620 is coupled to the blood insertion point 615 to draw blood from the insertion point 615. A triangular shape allows for visual inspection to determine if enough blood is loaded for testing. A deformable adhesive membrane 630 may be used and depressed after blood has been drawn into the card. The membrane seals blood loading and prevents backflow. A layer switching point 640 ensures minimum volume of air between sample and card interface while still keeping the sample fully contained in the card. A gas permeable membrane 650 allows air to flow through while preventing liquid flow. In one embodiment, the backside of the membrane has a vacuum applied to it and pulls air form the card until blood comes into contact with both ends signaling a complete fill. A reagent line 660 is formed to provide reagent to selected portions of the card as needed. A further gas permeable membrane is provided at a single end channel.

Figure 7:
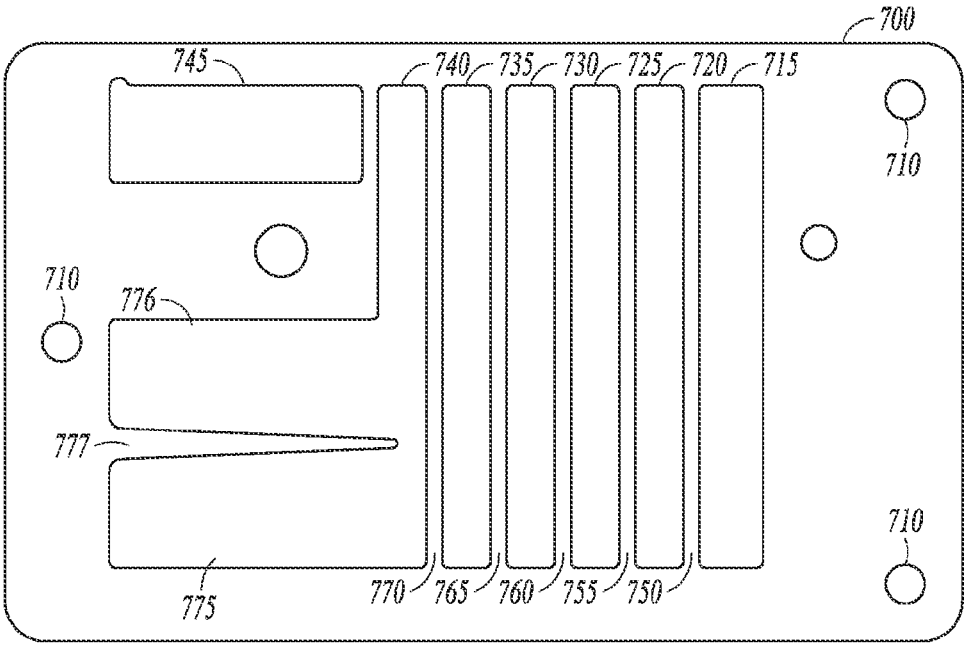
FIG. 7 is a block diagram planar view of a chamber layer of a further alternative example embodiment.

FIG. 7 is a block diagram planar view of a chamber layer 700 of a further alternative example embodiment. Chamber layer 700 includes seven chambers 715, 725, 730 735, 740, and 745 of varying sizes arranged in succession. The sizes and shapes of the chambers may be varied in different embodiments, and are shown in this embodiment as separated by ribs to allow for structural stability of the layer 700. Chambers 715, 725, 730, 735 are shown as simple rectangles separated by ribs 750, 755, 760, and 765. Chambers 735 and 740 are separated by rib 770. Chamber 740 includes two extended areas 775, 776 separated by a rib 777, again to provide structural support for layer 700. In one embodiment, a vent is provided by a capping layer that is not shown, to chamber 745, the last chamber. Chamber 745 is shown as a smaller chamber in one embodiment. The sizes of the chambers are selected to ensure that all waste liquid from testing performed in other layers may be contained on the card.

Figure 8:
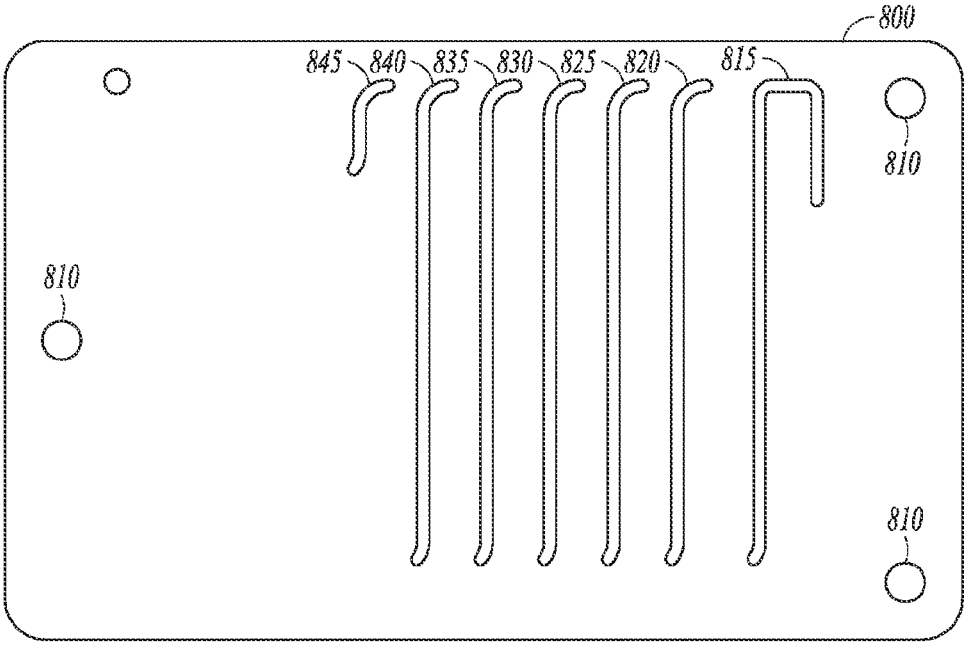
FIG. 8 is a block diagram planar view of a pass layer of an alternative example embodiment of FIG. 7.

FIG. 8 is a block diagram planar view of a pass layer 800 illustrating passes between the chambers of layer 700. Layer 800 includes alignment features 810 to align layers 800 and 700 via features 710. A waste pass 815 receives waste liquid and delivers the liquid to a bottom of chamber 750. A pass 820 is coupled to the top of chamber 715 and to the bottom of adjacent chamber 720 to provide for fluid transfer between the adjacent chambers. While chamber 715 is filling, air is transferred to chamber 720 via pass 820. When chamber 715 is filled, pass 820 transfers waste liquid to the bottom of chamber 720. This process is repeated to successive adjacent chambers by passes 825, 830, 835, 840, and 845, which are similarly coupled between adjacent chambers. The chambers thus successively fill with waste liquid, while air is exited to ambient from final chamber 745 via a vent in a final capping layer, not shown.

EXAMPLES

1. A multiple layer test card comprising:

a waste channel to receive biological waste from an area of the test card utilized for testing biological samples;

multiple compartments in a waste layer of the card, each compartment being separated by a rib in the waste layer, and a first compartment receiving biological waste from the waste channel;

a pass between each adjacent set of compartments to pass biological waste and air between compartments; and a vent in a last compartment to provide an air exit from the card.

2. The card of example 1 and further comprising an air permeable, liquid impermeable membrane positioned to prevent liquid from exiting the card.

3. The card of any of examples 1-2 wherein the passes are on a layer adjacent the waste layer that is adapted to cap other layers of the card.

4. The card of any of examples 1-3 wherein a pass between adjacent compartments exits an upstream compartment at a bottom of the compartment and enters a downstream compartment at a bottom of the compartment with respect to gravity when the card is properly oriented in a test instrument.

5. The card of example 4 wherein air passes out of a compartment via a pass to a downstream compartment as the compartment is filled with biological waste.

6. The card of any of examples 1-5 wherein the waste layer thickness and compartment sizes are dimensioned to contain all the biological waste on a card from testing.

7. The card of any of examples 1-6 wherein the ribs are adapted to fluidically separate adjacent compartments and to provide structural support within the card.

8. The card of any of examples 1-7 wherein the card is formed of other layers to process biological samples for testing by a test instrument when the card is inserted into the test instrument.

9. The card of any of examples 1-8 and further comprising an orientation feature to orient the card with respect to the test equipment.

10. A method comprising:

receiving waste liquid at a cover layer, the waste liquid being received from a layer on a multiple layer test card;

using a waste pass in the cover layer to provide the received waste liquid to a waste receiving chamber in a waste storage layer;

using multiple passes in the cover layer to pass liquid and air through multiple rib separated waste storage compartments in the waste storage layer; and exhausting air from the waste storage compartments to ambient outside the card.

11. The method of example 10 wherein the air is exhausted through a gas permeable, liquid impermeable membrane separating the compartments from ambient.

12. The method of any of examples 10-11 wherein the waste liquid is passed sequentially through multiple adjacent rib separated compartments, 13. The method of any of examples 10-12 wherein the passes transfer liquid and air from a top of one compartment to a bottom of an adjacent compartment.

14. The method of any of examples 10-13 and further comprising inserting the card into a test fixture in an orientation such that gravity causes the liquid to be oriented in the compartments in a selected manner with respect to the multiple passes.

15. The method of example 14 wherein are orientation feature on the card ensures the card is inserted correctly into the test fixture.

16. The method of any of examples 10-15 wherein air passes out of a compartment via a pass to a downstream compartment as the compartment is filled with biological waste, 17. A method comprising:

forming multiple rib separated adjacent compartments in a waste storage layer of a multiple layer biological liquid test card;

forming a cap layer having multiple passes, the passes coupled to alternate top and bottom portions of adjacent rib separated adjacent compartments; and wherein the cap layer is further formed with a vent to exhaust gas from the card via a last compartment.

18. The method of example 17 wherein the vent is formed with a gas permeable, liquid impermeable membrane.

19. The method of any of examples 17-18 wherein the compartments are formed with dimensions to adequately store all waste to be processed by the biological liquid test card.

20. The method of any of examples 17-19 wherein at least three adjacent rib separated adjacent compartments are formed.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A multiple layer test card comprising:

a test layer adapted to receive and test a biological sample;

a waste channel coupled to receive biological waste from the test layer;

multiple adjacent waste compartments in a waste layer of the card, separate from the test layer, each compartment being separated by a rib in the waste layer, and a first waste compartment receiving biological waste from the waste channel;

a pass layer separate from the waste layer and having multiple passes coupled between each adjacent set of waste compartments to pass biological waste and air between adjacent waste compartments, wherein the passes comprise an air pass at a top of the adjacent waste compartments and a biological waste pass at a bottom of the adjacent waste compartments; and a vent in a last compartment to provide an air exit from the card.

2. The card of claim 1 and further comprising an air permeable, liquid impermeable membrane positioned to prevent liquid from exiting the card.

3. The card of claim 1 wherein the passes are on a layer adjacent the waste layer that is adapted to cap other layers of the card.

4. The card of claim 1 wherein a pass between adjacent waste compartments exits an upstream compartment at a bottom of the compartment and enters a downstream compartment at a bottom of the compartment with respect to gravity when the card is properly oriented in a test instrument.

5. The card of claim 4 wherein air passes out of a compartment via a pass to a downstream compartment as the compartment is filled with biological waste.

6. The card of claim 1 wherein the waste layer thickness and compartment sizes are dimensioned to contain all the biological waste on a card from testing.

7. The card of claim 1 wherein the ribs are adapted to fluidically separate adjacent compartments and to provide structural support within the card.

8. The card of claim 1 wherein the card is formed of other layers to process biological samples for testing by a test instrument when the card is inserted into the test instrument.

9. The card of claim 1 and further comprising an orientation feature to orient the card with respect to the test equipment.

10. The card of claim 1 wherein the pass between each adjacent set of waste compartments to pass biological waste and air between adjacent waste compartments comprises an air pass at the top of the adjacent waste compartments and a biological waste pass at the bottom of the adjacent waste compartments.

11. The card of claim 1 wherein the pass between each adjacent set of waste compartments is in a layer adjacent to the waste layer.

12. The card of claim 1 wherein the area of the test card utilized for testing biological samples comprises a testing layer, and wherein the waste channel extends between the testing layer and the waste layer.

13. A multiple layer test card comprising:

a waste channel to receive biological waste from a test layer of the test card adapted to receive and test biological samples;

multiple adjacent waste compartments in a separate waste layer of the card, each compartment being separated by a rib in the waste layer, and a first waste compartment coupled to receive biological waste from the waste channel, wherein the waste channel extends between the test layer and waste layer;

a pass between each adjacent set of waste compartments in a separate pass layer coupled to the waste compartments to pass biological waste and air between adjacent waste compartments;

And further wherein the pass layer has multiple passes coupled between each adjacent set of waste compartments to pass biological waste and air between adjacent waste compartments, wherein the passes comprise an air pass at a top of the adjacent waste compartments and a biological waste pass at a bottom of the adjacent waste compartments; and A vent in a last compartment to provide an air exit from the card.

* * * * *